US011515654B2

(12) United States Patent
Chapman et al.

(10) Patent No.: US 11,515,654 B2
(45) Date of Patent: Nov. 29, 2022

(54) ELECTRICAL CONNECTOR WITH ROTATABLE BIASING MEMBER

(71) Applicant: TECHNETIX B.V., Veenendaal (NL)

(72) Inventors: Paul Chapman, West Sussex (GB); Gareth Shelley, West Sussex (GB); David Martin, West Sussex (GB)

(73) Assignee: TECHNETIX B.V., Veenendaal (NL)

( * ) Notice: Subject to any disclaimer, the term of this patent is extended or adjusted under 35 U.S.C. 154(b) by 0 days.

(21) Appl. No.: 17/307,103

(22) Filed: May 4, 2021

(65) Prior Publication Data

US 2021/0351524 A1 Nov. 11, 2021

(30) Foreign Application Priority Data

May 6, 2020 (GB) ..... 2006693

(51) Int. Cl.
*H01R 4/48* (2006.01)
*H01R 9/05* (2006.01)
*H01R 24/54* (2011.01)

(52) U.S. Cl.
CPC ..... *H01R 4/4818* (2013.01); *H01R 9/05* (2013.01); *H01R 24/54* (2013.01)

(58) Field of Classification Search
None
See application file for complete search history.

(56) References Cited

U.S. PATENT DOCUMENTS

| | | | |
|---|---|---|---|
| 3,806,860 | A | 4/1974 | Flammini |
| 5,219,299 | A | 6/1993 | Wang |
| 7,614,922 | B1 | 11/2009 | Buse |

FOREIGN PATENT DOCUMENTS

| | | | |
|---|---|---|---|
| EP | 0592336 | A1 | 4/1994 |
| EP | 0769827 | A1 | 4/1997 |
| WO | 9642121 | A1 | 12/1996 |

*Primary Examiner* — Ross N Gushi
(74) *Attorney, Agent, or Firm* — SZDC Law P.C.

(57) ABSTRACT

There is provided a connector comprising an electrically conductive member (48) fixed in position within a rotatable insulating body (42), the electrically conductive member (48) comprising at least one connection channel (72, 74), a biasing member (46) such as a torsion spring connected to the insulating body (42), and an insertion axis (94), wherein the rotatable insulating body (42) is formed with at least one tapered guide channel (44) in which is located an insertion axis and the insulating body (42) is rotatable from a first biased position in which the at least one tapered guide channel (44) is offset from the connection channel (72, 74) to a second biased position where the at least one connection channel (72, 74) is aligned with the insertion axis (94). The electrically conductive member (48) is rotatable against a biasing force of the biasing member (46) upon insertion of a conductor pin.

12 Claims, 4 Drawing Sheets

ELECTRICAL CONNECTOR WITH ROTATABLE BIASING MEMBER

This application claims priority to Great Britain Patent Application No. 2006693.2, filed on May 6, 2020, which is incorporated by reference for all purposes as if fully set forth herein.

FIELD OF THE INVENTION

This invention relates to connectors used to establish an electrical connection, and in particular connectors used in telecommunication and electrical networks.

BACKGROUND TO THE INVENTION

As the demand for increased signal and data throughput on broadband/CATV cable networks continues to rise, service providers strive to increase the bandwidth of their networks and the top operating frequencies rise.

Junction boxes used in these networks for splitting/combining RF signals, require low signal loss cable terminations that can pass RF signals and also high AC/DC current for powering line equipment. Traditionally this is achieved by screw clamping onto a cable conductor core within the junction box.

The impedance of the junction box needs to be matched to that of the network to allow effective signal transmission. As the operational signal frequency increases, the impedance matching of the cable terminations becomes more critical as signal attenuation due to impedance mismatch tends to increase with frequency. Screw clamping connectors are a poor impedance match to the cable network but are adequate at frequencies up to around 1 GHz but at frequencies above this they start to cause significant signal attenuation due to the impedance mismatch.

SUMMARY OF THE INVENTION

In accordance with the present invention, there is provided a connector comprising an electrically conductive member fixed in position within a rotatable insulating body, the electrically conductive member comprising at least one connection channel, and a biasing member connected to the insulating body, wherein the insulating body is formed with at least one tapered guide channel in which is located an insertion axis and the insulating body is rotatable from a first biased position in which the at least one tapered guide channel is offset from the at least one connection channel to a second biased position where the at least one connection channel is aligned with the insertion axis, thereby to allow insertion of an elongate conductor, such as a conductor pin, into the electrically conductive member whilst the biasing member resists withdrawal of the pin from the electrically conductive member. Thus a conductor pin, for example forming the central core of a coaxial cable, is insertable along the insertion axis to establish an electrical connection with the electrically conductive member. When such a connector is disposed within a distribution tap or junction box, an electrical connection can be established between an external trunk cable, such as a coaxial cable, and a PCB within the tap or box.

The insulating body is preferably rotatable upon insertion of a conductor pin into the at least one tapered guide channel. In use when a conductor pin is inserted along the insertion axis, the insulating body is rotated against the biasing force exerted by the biasing member, rotating from the first biased position to the second biased position and aligning the insertion axis and connection channel. This allows the conductor pin to enter the connection channel and thus to establish electrical contact with the electrically conductive member, and so establish electrical contact with a PCB connected to the electrically conductive member.

The electrically conductive member is preferably elongate and is typically connectable to a PCB.

The electrically conductive member may comprise two intersecting connection channels, so as to form four orthogonally spaced entrances suitable for receiving an externally inserted conductor pin.

The biasing member is preferably a spring and more preferably a torsion spring.

The biasing member may further comprise fixing elements, typically in the form of apertures formed in the biasing member with fixing screws or pins, so that the biasing member can be secured in position, for example within a connector housing, tap housing or junction box housing.

The insulating body may be formed with one or more seating portions on which the biasing member is locatable.

The body may be formed with one or more further guide channels to receive an externally insertable conductor pin, such as pin connected to the centre conductor of a coaxial cable.

The insulating body may be formed with at least two orthogonally disposed arms. Typically distribution taps and junction boxes have one or more orthogonally disposed inlets for connecting to trunk cables so having at least two orthogonally disposed arms ensures that connection can be made with either inlet.

The insulating body may be formed as two separate parts connectable together to secure the electrically conductive member, with preferably the electrically conductive member biased to the first position by the biasing member acting on the insulating body.

The connector may further comprise an element fixed in relationship to the biasing member so as to define an insertion channel aligned with the insertion axis, for example an insulated bushing element. Such an element may be incorporated into the connector or used in combination with the connector, for example when the connector forms part of a distribution tap.

The invention will now be described, by way of example, with reference to the accompanying drawings in which:

FIGS. 1(*a*) and 1(*b*) show a perspective and a cut-away view respectively of a prior art distribution tap;

DESCRIPTION

Figure 1A:
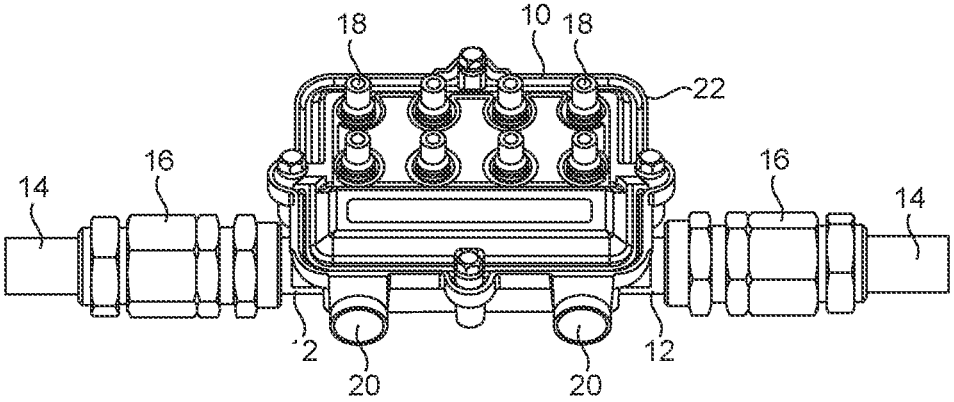
Figure 1B:
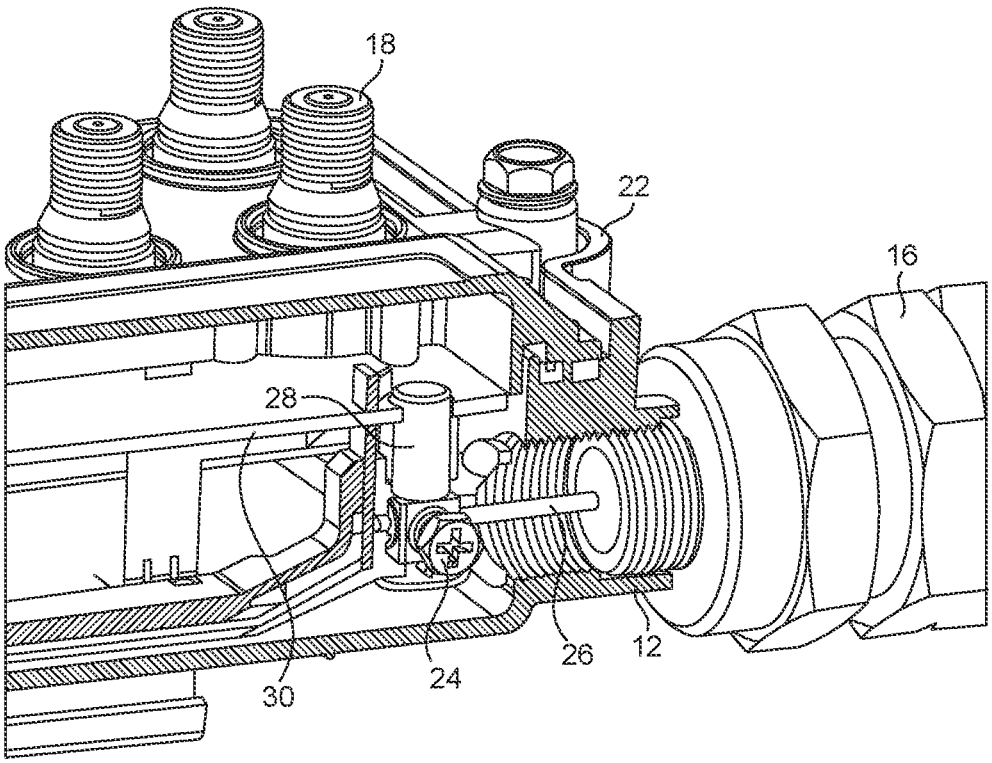

FIGS. 1(*a*) and 1(*b*) show a prior art distribution tap 10 used in broadband and CATV networks. Tap 10 is connected at trunk ports 12 to a trunk coaxial cable 14 using trunk connectors 16. Cable 14 carries bi-directional signals through the network and users connected to ports 18 are able to send and receive signals. If desired, trunk cable 14 can be connected to tap 10 using alternative trunk ports 20. A close up within tap housing 22 is shown in FIG. 1(*b*) where a clamping screw 24 at right-angles to trunk connector 16 is used to clamp an in/out trunk conductor pin 26 to printed circuit board (PCB) connector 28 so as to establish an electrical connection with components on PCB 30. Above frequencies of 1 GHz, the large size and non-symmetrical shape of the screw clamp mechanism make it difficult to maintain a matched impedance within the connector, resulting in signal attenuation at frequencies above 1 GHz to the detriment of the signal.

Figure 2:
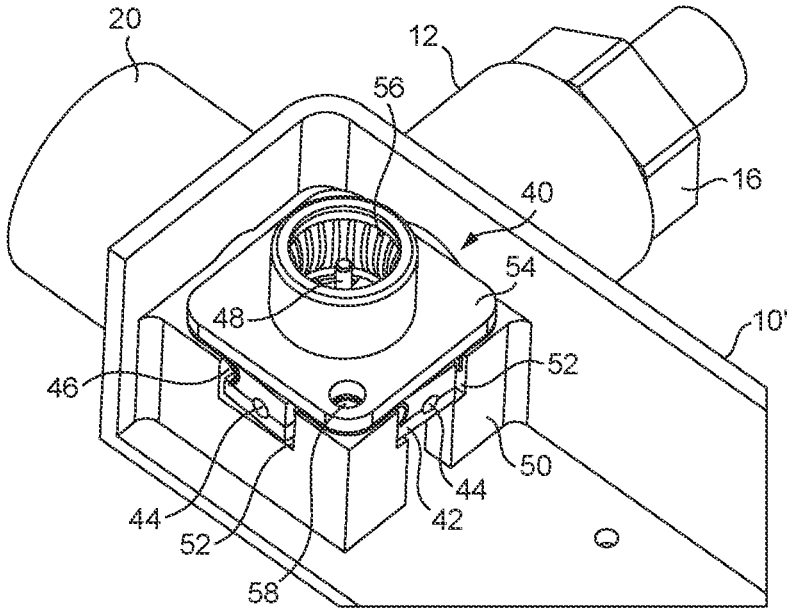
FIG. 2 shows a cut-away view of part of a distribution tap incorporating a connector in accordance with the present invention.

FIG. 2 is a cut-away view of part of a distribution tap 10', or junction box, to show connector 40 in accordance with the present invention. Connector 40 is located proximal trunk ports 12, 20 and comprises a body 42 formed with channels 44, a torsion spring 46 and a metal post 48. Body 42 is typically made of insulating plastics material and acts as an insulated bush. Connector 40 is able to receive trunk conductor pin of trunk connector 16 and establish electrical contact between pin 26 and metal post 48, with post 48 in turn establishing electrical contact with a printed circuit board within tap 10'.

Typically tap 10' is integrally formed with internal support 50 on which connector 40 is mounted, with support 50 being substantially rectangular with a central open channel and cut-away portions 52 on which body 42 sits. This ensures channels 44 are positioned at a height corresponding to that at which a connector pin will be introduced into outlet/inlet trunk ports 12, 20. Positioned above body 42 is a PCB terminal housing 54 within which is located a PCB grounding spring 56 with this secured to support 50 using fixings through two diagonally spaced apart apertures 58, only one of which is visible.

Figure 3A:
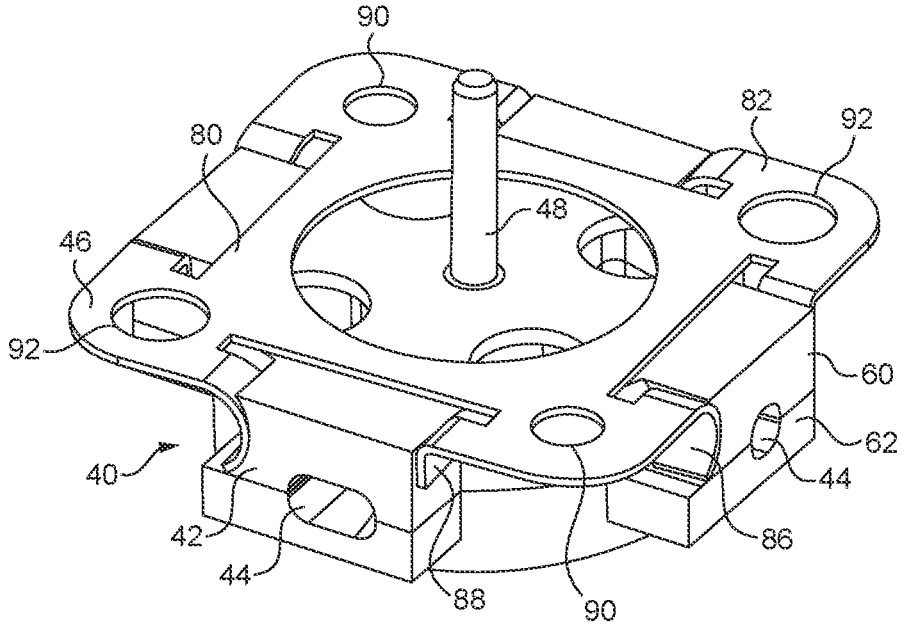
FIG. 3(*a*) shows the connector before placement in a tap with FIG. 3(*b*) showing an exploded view of the parts forming connector.
Figure 3B:
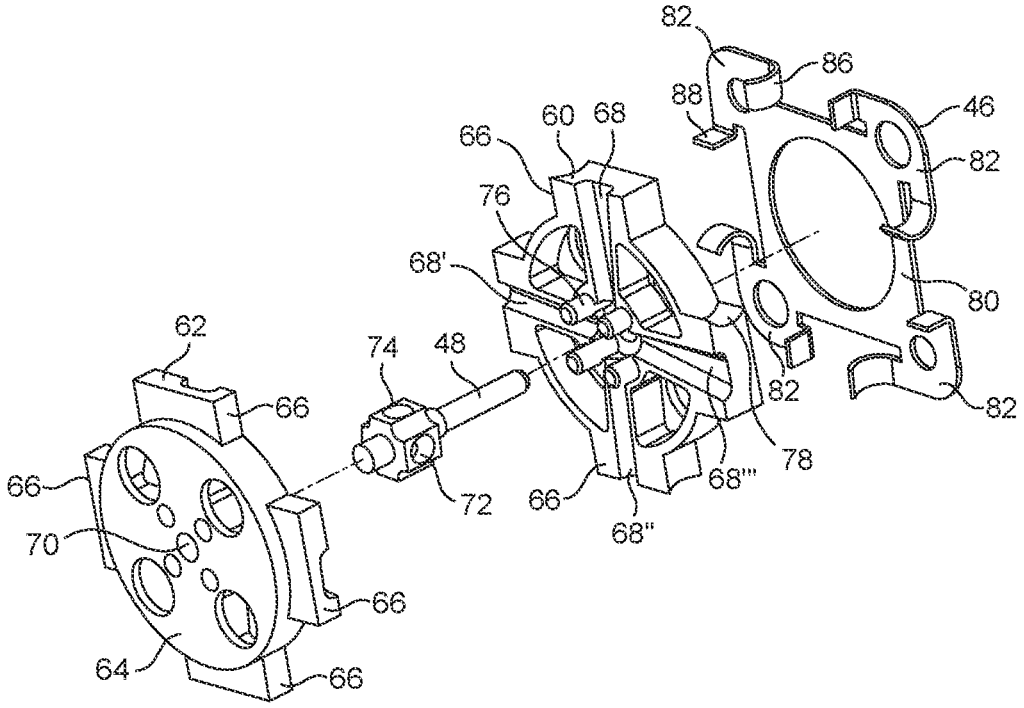

FIG. 3(*a*) shows connector 40 before placement in tap 10' with FIG. 3(*b*) showing an exploded view of the parts forming connector 40.

Body 42 consists of upper and lower sections 60, 62, each formed with a central cylindrical section 64 and four circumferentially equi-spaced arms 66 depending from section 64 so as to give a substantially cross-shaped body 42. Each upper and lower section 60, 62 is formed with four grooves 68, 68', 68" and 68'", see FIG. 4, leading inwards from an outermost edge of each arm 66 to form a cross-shape. Disposed at the intersection of arms 66 is central aperture 70 for receiving metal terminal post 48, with metal post 48 formed with two intersecting channels 72, 74 so as to provide four connection apertures to receive pin 26.

As can be seen in FIGS. 3(*a*) and 4, grooves 68, 68', 68" and 68'" are radially misaligned with respect to arms 66 so that the entrance to channel 44 is offset from the centre of each arm 66 for each of the grooves. Grooves 68, 68'" taper inwards to aperture 70, with the side walls set at slightly different angles to provide tapering in combination with offset. For grooves 68' and 68", the radial misalignment is achieved by constant width grooves angled within the arm. If desired, each section 60, 62 could have two grooves disposed at 90° to each other instead of four grooves. This would produce an L-shaped channel with the bend of the L being located at aperture 70, ensuring connector 40 would be able to accommodate two orthogonally disposed connection points, such as trunk ports 12, 20.

The two sections 60, 62 are substantially identical although with complementary fixings 76 to allow them to be connected together using a push-fit connection. Upper body 60 has a curved seat 78 associated with each arm 66 so as to assist with location of torsion spring 46.

Torsion spring 46 comprises a substantially rectangular central section 80 with at each corner a spring element 82 comprising a downwards curved edge 86 and a downturned straight edge 88. Torsion spring 46 is formed as a complementary shape to body 42 so that central section 80 sits on upper section 60 and spring elements 82 locate and secure in the gaps between adjacent arms 66. Location holes 90 and screw holes 92 are formed in spring 46 to ensure spring 46 can be restrained by securing to a support or other structure.

During assembly of connector 40, post 48 is positioned within central aperture 70 of each body section 60, 62 and body sections 60, 62 snap-fitted together using complementary fixings 76 so as to secure post 48 in position as seen in FIG. 3(*a*). The four spring elements of spring 46 are then snapped into position between arms 66 of body 42 and two location holes 90 and two screw holes 92 radially positioned such that when assembled to housing 22 the axis of each connection channel or cross-hole in terminal pin 48 is held under spring pressure in mis-alignment to the inlet/outlet port insertion axis 94, see FIG. 4.

After assembly of the terminal post assembly formed by body sections 60, 62, post 48 and torsion spring 46, PCB terminal housing 54 with PCB grounding spring 56 is inserted into location holes 90 in torsion spring 46. The connector 40 is then inserted into support 50 and screwed into position as shown in FIG. 2 such that connector 40 is restrained vertically but body 42 is able to rotate about the vertical axis of post 48 within the constraints of housing slots 52 and the spring force of torsion spring 46. An insulating guide bush 96 made of plastics material is inserted into trunk port 22 to limit radial movement of conductor pin 26 as it is inserted along insertion axis 94. If desired, bush 96 can be incorporated into connector 40.

Figure 4:
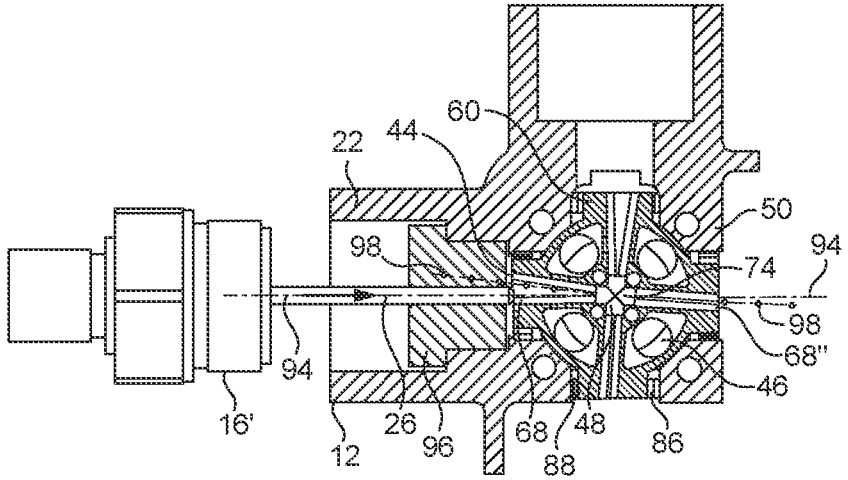
FIGS. 4 to 6 show sections through part of the tap from below as a conductor pin is inserted so as to illustrate operation of the connector.
Figure 5:
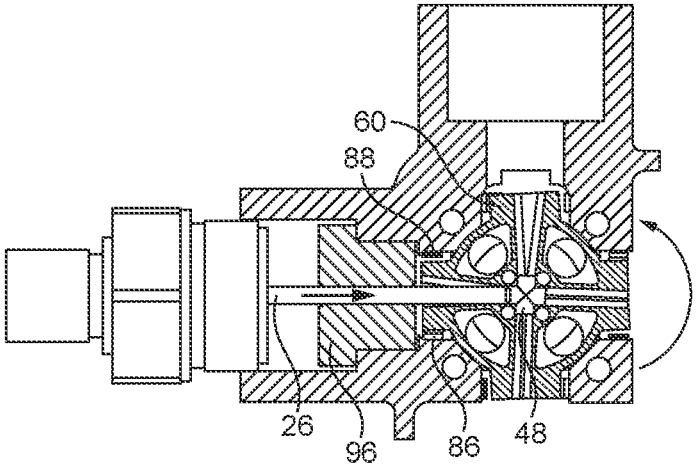
Figure 6:
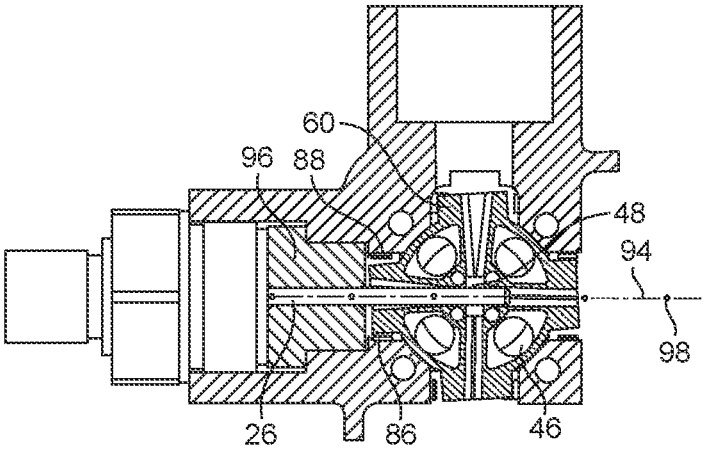

FIGS. 4 to 6 illustrate connector 40 in use. Terminal pin 38, which alternatively could be a socket, is rigidly mounted in body 42 which is mounted in housing 22 in a manner that allows limited radial movement. Torsional spring 46 acting on body 42 sets the first parked position of the terminal pin or socket 48 such that the axis of the connecting channels 72, 74 in terminal 48 are radially misaligned with the axis of trunk port 12 in housing 22.

On insertion of trunk connector 16' into trunk port 12, a guide bush 96 in housing 22 directs centre conductor pin 26 of connector 16' along insertion axis 94 towards terminal 48.

As conductor pin 26 is urged into channel 44, see FIG. 4, channel 44 guides pin 26 towards connecting channels 72, 74 in terminal 48. It can be seen that insertion axis 94 and channel axis 98 are not in alignment and are offset from each other.

As conductor pin 26 continues to be driven/forced into guide channel 44, see FIG. 5, the terminal post assembly formed of upper and lower sections 60, 62 and terminal 48 radially turns against the force applied by torsion spring 46. The terminal post assembly continues to rotate against the torsion spring force until insertion axis 94 and channel axis 98 align and conductor pin 26 is able to enter connection channel 74 and extend just beyond terminal 48, see FIG. 6. When in this aligned position, arms 66 have been rotated so as to be disposed closer to one side of their respective housing slot 52.

The biasing force of torsion spring 46 acts to resist removal of pin 26 once inserted so ensuring pin 26 is restrained without any additional fixing of pin 26 to post 48.

This construction of connector 40 removes the requirement for any manual screw fixing of the mating conductor and its associated pin. All metal components are small and symmetrical in shape, enabling the characteristic impedance of the connector to be tightly controlled and operational frequencies up to and above 3 GHz to be achieved. Additionally, the constant radial force on the centre contacts and the large contact area result in a low contact resistance. This enables large currents up to and above 15A to pass without significant heating of the connector.

The mechanical connector design for the main cable line inlet and outlets plays a significant factor in effective matching of the impedance of the junction box to that of the network to allow effective signal transmission.

The invention claimed is:

1. A connector comprising an electrically conductive member fixed in position within a rotatable insulating body, the electrically conductive member comprising at least one connection channel, and a biasing member connected to the insulating body, wherein the insulating body is formed with at least one tapered guide channel in which is located an insertion axis and the insulating body is rotatable from a first biased position in which the insertion axis of the at least one tapered guide channel is offset from the connection channel to a second biased position where the at least one connection channel is aligned with the insertion axis.

2. A connector according to claim 1, wherein the insulating body is rotatable upon insertion of a conductor pin into the at least one tapered guide channel.

3. A connector according to claim 1, wherein the electrically conductive member is elongate.

4. A connector according to claim 1, wherein the at least one electrically conductive member comprises two intersecting connection channels.

5. A connector according to claim 1, wherein the biasing member is a torsion spring.

6. A connector according to claim 5, wherein the biasing member further comprises fixing elements.

7. A connector according to claim 1, wherein the insulating body is formed with one or more seating portions on which the biasing member is locatable.

8. A connector according to claim 1, wherein a plurality of guide channels are provided.

9. A connector according to claim 1, wherein the insulating body is formed with at least two orthogonally disposed arms.

10. A connector according to claim 1, wherein the insulating body is formed as two separate parts connectable together to secure the electrically conductive member.

11. A connector according to claim 1, further comprising an element fixed in relationship to the biasing member to define an insertion channel aligned with the insertion axis.

12. A connector according to claim 1 when used in combination with an element fixed in relationship to the biasing member to define an insertion channel aligned with the insertion axis.

* * * * *